United States Patent [19]

van Hoorn

[11] 4,214,712

[45] Jul. 29, 1980

[54] MICRO-MILL-MIXER

[76] Inventor: Jacques J. B. van Hoorn, 21 Rue A. Hottat, 1050 Bruxelles, Belgium

[21] Appl. No.: 894,238

[22] Filed: Mar. 28, 1978

[30] Foreign Application Priority Data

Apr. 28, 1977 [BE] Belgium ..... 0177082

[51] Int. Cl.[2] ..... B02C 23/36

[52] U.S. Cl. ..... 241/46 B; 241/46.11; 241/46.17

[58] Field of Search ..... 241/46 R, 46 A, 46 B, 241/46.11, 46.17, 46.06, 257 G, 46.02, 46.13, 39, 40, 257 R, 258; 366/263, 265, 295; 51/163.1, 131.3

[56] References Cited

U.S. PATENT DOCUMENTS

| | | | |
|---|---|---|---|
| 423,502 | 3/1890 | Watson et al. | 241/46.06 |
| 1,031,666 | 7/1912 | Richmond | 366/265 |
| 2,468,389 | 4/1949 | Auer | 241/46.06 X |
| 2,577,152 | 12/1951 | Powers | 241/46 B |
| 2,619,330 | 8/1950 | Willems | 241/46 R |
| 2,715,735 | 8/1955 | McPherson | 241/46.06 X |
| 2,730,308 | 1/1956 | Jordan | 241/46 B |
| 2,947,486 | 8/1960 | Higer | 241/46.11 X |
| 3,472,390 | 9/1967 | Pall | 241/46 R |
| 3,780,956 | 12/1973 | Miller | 241/46.11 |

*Primary Examiner*—Howard N. Goldberg
*Attorney, Agent, or Firm*—John J. Dennemeyer

[57] ABSTRACT

The invention relates to a micro-mill-mixer for treating in an enclosure particles carried in a fluid, the mixer comprising an accelerator to propel the particles onto an abrasive disk to produce intense splitting, slicing and particle shearing as well as fluid division jointly with coating of the particles by the fluid to form an intimate mix.

5 Claims, 22 Drawing Figures

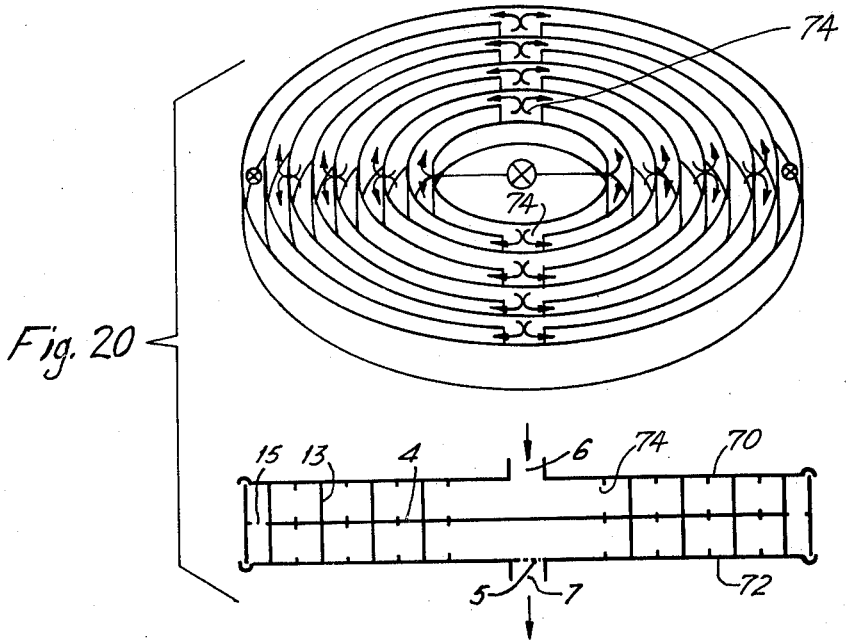
Fig. 20
Fig. 21.
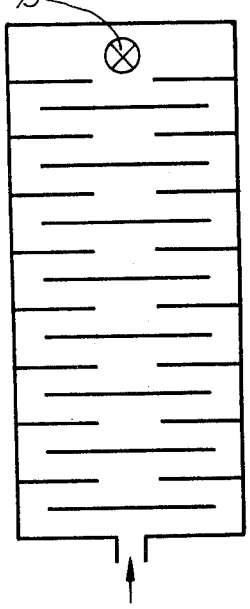
Fig. 22.
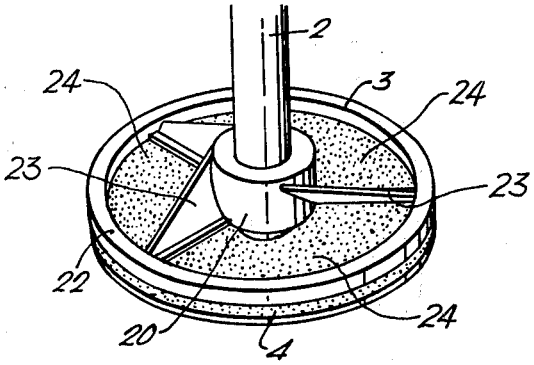

MICRO-MILL-MIXER

BACKGROUND OF THE INVENTION

The present invention relates to a micro-mill-mixer and more particularly to micro-milling and mixing machines for applications similar to those in which sand or micro-bead-mills employed to mill particles down to micron size.

SUMMARY OF THE INVENTION

In accordance with the invention the micro-mill-mixer comprises an enclosure for treating particles carried in a fluid (hereinafter sometimes referred to as "material") to be accelerated therein, at least one accelerator means providing both centrifugal and centripetal motion of the particles and the fluid, and an abrasive means having at least one face provided with an abrasive coating. The accelerator and the abrasive means are positioned relative to one another so that the particles and the fluid are projected onto the abrasive means and against the abrasive coating to produce intense splitting, slicing and particle shearing as well as fluid division jointly with coating of the particles by the fluid to form an intimate mix. The accelerator and abrasive means are furthermore positioned so as to provide a continuous repetitive circulation of the particles and fluid over the abrasive means.

BRIEF DESCRIPTION OF THE DRAWINGS

The FIGS. 1 to 22 are schematical representations of different embodiments of the invention.

DESCRIPTION OF THE PREFERRED EMBODIMENTS

Figure 1:
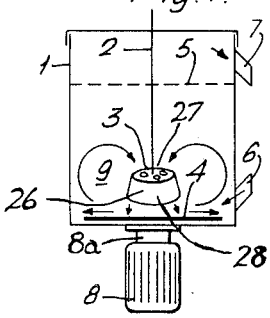

In the different Figures of the drawings corresponding parts are identified by the same reference numerals.

FIG. 1 is a schematic representation, partially in section and partially perspective, or a micro-mill-mixer according to the invention comprising a milling enclosure 1, open or closed, under pressure or vacuum, into which a shaft 2 penetrates. The shaft 2 is equipped at its lower extremity with a propeller-reactor 3 providing a centrifugal and centripetal action. The propeller-reactor 3 has inner conduits 9 ejecting fluid and particles to be treated substantially axially. A disk 4 or the like, is provided at least at its upper face with a coating of abrasive products, such as emery, silicon carbide, corundum, borazon or other suitable material, forming hard, sharp crystalline cutting points 24 (FIG. 22).

The abrasive disk 4 is shown as being mounted on a shaft 8*a* of a motor 8 which may rotate in the opposite or in the same direction as the propeller-reactor.

In a modified embodiment the disk 4 may be fixed in a stationary manner to the bottom of the enclosure which it covers partly or completely. The disk shall be hereinafter designated by the expression "abrasive means" or "abrasive disk".

The enclosure 1 has an inlet pipe 6 and an outlet pipe 7. The enclosure 1 may also be optionally provided with a filter 5.

In operation the shaft 2 provided with the propeller-reactor 3 is rotated in the enclosure 1 containing the liquid vehicle and the particles to be milled. The propeller 3 comprises one essentially central entry collector 26 having the shape of a hollow cylinder including one opening at one side 27 and a and essentially closed bottom on the other side 28, and holes 3*a* disposed in at least one row concentric to the motor shaft in which are fixed a plurality of individual conduits 9 which are closed except at their extremities. The space or inner volume of one single row of conduits occupies a space or volume which is less than 33% of the space or volume disposed between two surfaces located tangentially on both sides of the conduits of the row of conduits and delimited by the peripheral extremities of the latter, excluding the space or volume of the hollow cylinder disposed between the two afore-mentioned surfaces, and the cylinder occupies a space or volume approximately equal to the space or volume of the row of conduits.

The surfaces described as well as the conduits, may be positioned essentially horizontally or at any desired angle.

The propeller-reactor may be cone-shaped and provided with conduits opening at the small end of the cone and emerging at its base.

One feature of this latter construction is that the volume of material ejected by centrifugal force is compensated by a centripetal aspiration of an equivalent volume creating a balanced centripetal and centrifugal flow, which is very important for efficient operation.

Some accelerators do not have balanced centrifugal and centripetal action, but eject material mostly centrifugally. In this case the accelerator/enclosure diameter ratio shall be chosen so that the material, i.e. the fluid and particles, is projected against the enclosure wall so as to rebound with sufficient force to create the required centripetal effect to assure central rejection of the fluid and particles and a continuous and repetitive milling action on the abrasive disk.

In certain cases, to be described herein, the centrifugal and centripetal effects shall be separated and exerted separately by two distinct means which may, individually, also produce the effects of abrasive disks.

When rotating, the conduits are emptied by centrifugal force while sucking from the top inlet 3*a* creates a continuous fluid circuit. The fluid and the particles are jointly accelerated and projected in continuous percussion or hammering against the abrasive disk 4 located at the enclosure bottom.

The particles and the fluid are subjected, on the abrasive material, to intense splitting, slicing and shearing of the particles as well as a division of fluid jointly with coating of the particles by the fluid into an intimate mix, while being projected toward the disk periphery. From the disk periphery the particles, along the enclosure wall to again enter the inlet of the propeller-reactor by the suction action thereof to be reworked as many times as desired.

Furthermore, all illustrated apparatus may operate continuously and ensure an efficient heat evacuation without a filter 5 positioned between the inlet and outlet pipes 6 and 7.

The milling effect is more aggressive than any obtained by micro-mills operating with sand or micro-beads because the machines according to the invention are not limited by the wear produced by the sand and the beads on the rotating disks and on the cooling wall of the apparatus.

Furthermore, the unfavorable effects of micro-bead "floatation" in viscous fluids is here completely eliminated.

Of course the propeller-reactors 3 may have large dimensions and rotate more or less slowly, in accordance with the material viscosity, and they may also be provided with forced feeding, while milling may comprise several stages in tandem operation.

It will be understood that the above-described elements and arrangement may have many different forms and embodiments, examples of which are shown in the drawing and mentioned below. In order that this specification be concise, many of the possible different forms and embodiments are illustrated only very schematically and described in general terms without an explanation of all the details of each embodiment. Taking the embodiments which are described and illustrated in more detail with those which are illustrated more schematically and described more briefly, will enable one skilled in the art to make and use the present invention.

Figure 2:
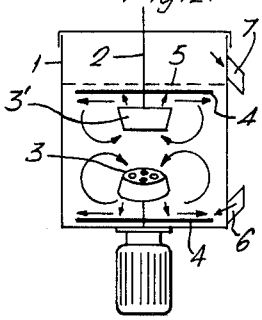

FIG. 2 illustrates in a sectional and partially perspective view two distinct embodiments, namely, a first propeller 3 ejecting material from the top to the bottom and driven by a shaft entering through the enclosure bottom, on which an abrasive disk 4 is mounted. This abrasive disk may be driven by a motor, as shown. or may be stationary. A second propeller 3' is shown in FIG. 2 which ejects material from the bottom toward the top against a rotating disk 4. The shaft 2 driving the second propeller 3' and the rotating disk 4 enters from the top into the enclosure.

Figure 3:
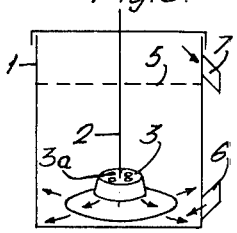

FIG. 3 represents a modification of the FIG. 1 embodiment, in that the abrasive disk is fixed in front of the propeller-reactor conduit outlets, on the same shaft 2 and rotates therewith.

Figure 4:
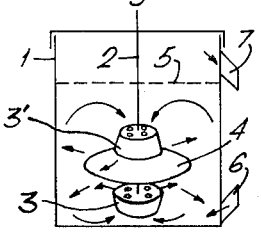

The embodiment of FIG. 4 is a modification of the embodiment of FIG. 3 comprising two propeller-reactors 3 and 3' fixed in opposition on a single shaft 2 with a disk 4 provided between the two propeller-reactors 3 and 3' and having its two faces coated with abrasive material.

Figure 5:
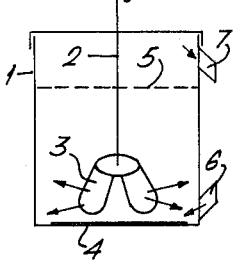

FIG. 5 represents a modification of the embodiment according to FIG. 1, and comprising a propeller in the form of a screw 3 ejecting material axially.

Figure 6:
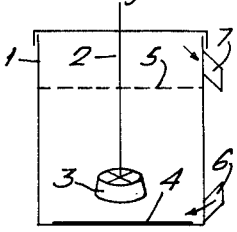

The embodiment of FIG. 6 is a modification of FIG. 5 and shows a propeller 3 in the form of a hollow cone distinct from the propeller-reactor of FIG. 2.

Figure 7:
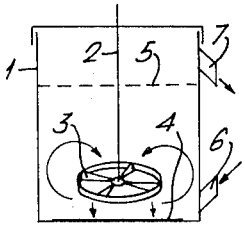

The embodiment of FIG. 7 is a modification of the embodiment of FIG. 6 and comprises an encircled screw 3 ejecting material axially.

Figure 8:
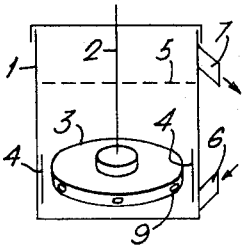

The embodiment of FIG. 8 is a modification of the embodiment of FIG. 1 in that the propeller-reactor 3 is provided with conduits 9 ejecting radially and an abrasive means 4 in the form of a circular band is positioned at the inner face of the enclosure 1 adjacent the conduit outlet openings.

Figure 9:
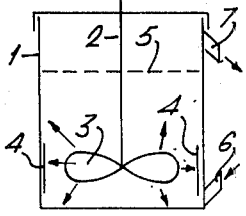

The embodiment of FIG. 9 is a modification of the embodiment of FIG. 8 and comprises a radially material ejecting srew 3.

Figure 10:
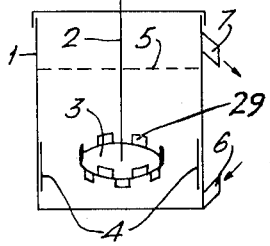

FIG. 10 shows a modification of the embodiment of FIG. 8 and comprises an impeller 3 of the turbine type provided with fixed teeth 29 where plane surfaces may be provided with abrasive material and with baffles to be described later in combination with FIG. 18.

Figure 11:
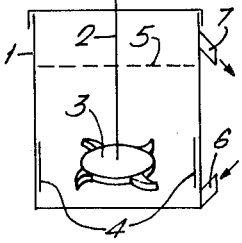

The embodiment of FIG. 11 is a modification of the embodiment according to FIG. 10, and comprises an impeller 3 of the turbine type provided with adjustable teeth.

Figure 12:
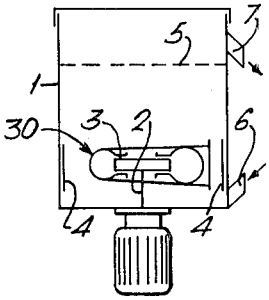

The embodiment of FIG. 12 is a modification of the embodiments according to FIGS. 10 and 11, and comprises a radial pump 30 positioned adjacent the bottom of the enclosure 1. The pump has an impeller 3 and is actuated by a motor shaft 2 extending through the bottom of the enclosure 1.

Figure 13:
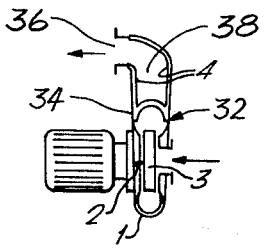

The embodiment of FIG. 13 is a modification of the embodiment of FIG. 12 and comprises an external radial pump 32 comprising an impeller 3 rotatable in an enclosure 1. The pump body 34 is provided at its outlet 36 with an outer chamber 38 extending substantially parallel to the outer pump wall. This outer chamber is provided with an inner face having an abrasive means 4 thereon, the pump operating preferably in a closed circuit of the enclosure 1.

Figure 14:
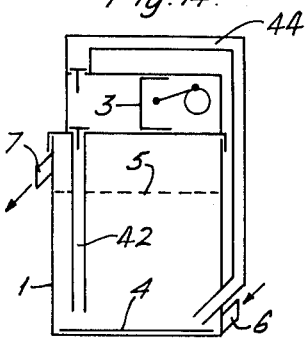

The embodiment of FIG. 14 is a modification of the embodiment of FIG. 12 and is provided with a diaphragm pump 3 connected by a suction conduit 42 and a material ejection conduit 44 to the enclosure 1, the ejection conduit outlet ejecting the particles and the fluid to be treated substantially tangentially onto the abrasive disk 4.

Figure 15:
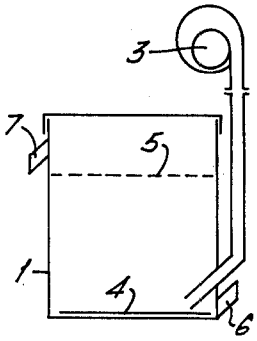

The embodiment of FIG. 15 is a modification of the embodiment according to FIG. 14 and is provided with a pump 3 for blowing a gaseous fluid carrying the particles against the abrasive disk 4.

Figure 16:
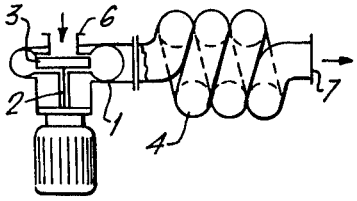

The embodiment of FIG. 16 is a modification of the embodiment according to FIGS. 14 and 15 and comprises a propeller 3 for fluids, liquids or gases. The outlet 7 of the enclosure 1 is connected to a spiral conduit, whose inner face is provided with abrasive material 4 products.

Figure 17:
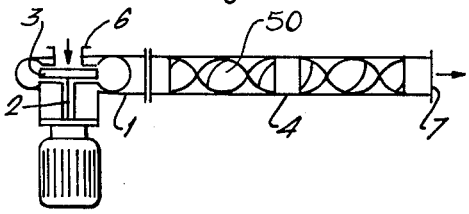

The embodiment according to FIG. 17 is a modification of the embodiment according to FIG. 16 and comprises a straight conduit containing an Archimedes screw 50, preferably sectioned, for forcing the material to be treated in successive circulation direction and comprising at least one face having coating 4 of abrasive products.

Figure 18:
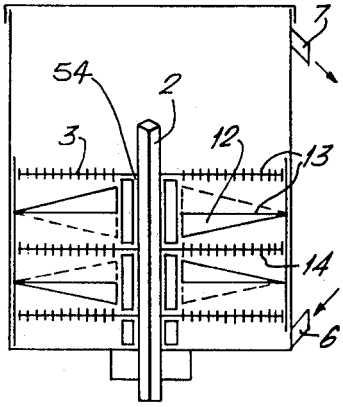

A preferred embodiment is shown in FIG. 18. The mill according to FIG. 18 comprises a shaft 2 entering through the bottom of the enclosure and preferably carrying several fluid accelerators, formed by disks 3, of a smaller diameter than the enclosure inside diameter. These disks 3 are coated with abrasive products on at least one face and cooperate with static baffles 12 positioned between the accelerators and extending centrally, preferably starting from the inner face of the enclosure wall towards the center. The baffles and disks may be provided with pins 13, 14 also coated with abrasive products.

The baffles 12 are formed for example by solid or perforated disks, coated on both faces with abrasive products and comprising a central opening 54 for the passage of the shaft and the travelling fluid carrying particles.

The rotation of the accelerators 3 creates a centrifugal motion of the fluid while the baffles 12 are formed and positioned to lead the fluid centripetally, orienting the fluid toward the center, and preferably, at the same time in the direction of the abrasive faces of the accelerators 3, the latter and the baffles jointly leading the fluid alternately from the center to the periphery and vice-versa, and exerting the double function of acceleration and abrasion while creating a balanced centrifugal anc centripetal flow.

Figure 19:
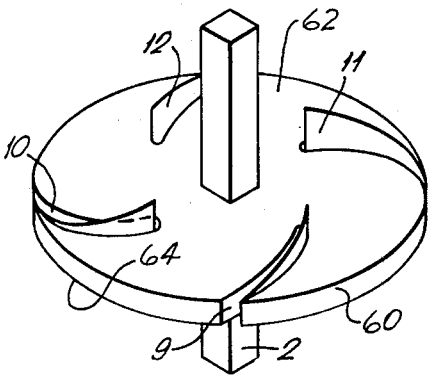

A similar effect is obtained by combining the accelerator and the abrasive disk into one single element (FIG. 19) formed by a disk 60 whose two faces 62, 64 are coated with abrasive material, perforated by grooves 9 (FIG. 19), and rotated clockwise. This disk produces a centrifugal action on the fluid thrown outwardly by the abrasive plane faces 62, 64 while the vertical walls 10 of the grooves 9, which may be extended by border 11, exert a centripetal action leading the fluid to the central groove end where it overflows onto the abrasive faces to be ejected centrifugally.

Solid disks, without grooves, but provided with fixed baffles 12 (also FIG. 19) emerging at the top of disk faces provide a similar effect.

Another embodiment of the mircro-mill is shown in FIG. 20 and comprises a conventional pump, not illustrated, and an abrasive disk 4 provided with baffles 13, enclosed between two lids 70, 72.

This disk 4 is provided, preferably on both faces, with baffles 13 preferably in the form of tube sections fixed perpendicularly to the plane face of the disk 4. The tube sections are of increasing diameter starting from the center and positioned concentrically to provide an open spacing between two successive tube sections. The outermost tube section extends outwardly from the two plane disk faces 70, 72 to form the outer periperal wall pressed between the two lids. The disk and tube section faces are coated with abrasive material. The upper lid comprises an inlet 6 and the lower lid has an outlet 7 which may be provided with a filter 5. Each tube section, except the outermost section, is provided with at least one perforation 74 in its wall, and furthermore the disk 4 is provided with at least one perforation 15 near its outer periphery. Closed by two lids the device forms a sealed enclosure wherein the tube sections define closed compartments having outlets extending through the tube sections. The outlets are positioned so as to face closed sections of adjacent tubes.

In operation, the fluid carrying the particles enters at the inlet 6 and reaches the first tube section wall, flows out through a perforation 74, is projected against the wall of the next tube section, is compelled to divide into two portions and then to circulate along the abrasive wall of this section to meet, in front of a perforation 74, another flow of material with which it collides and flows therewith through the perforation 74 to again strike a closed portion of a tube section. The flow then changes its direction, is divided into two flows and repeats the same procedure.

When arriving at the outer wall of the device the fluid carrying the particles flows through the opening near the disk periphery. It thus moves from one side of the disk to the other and flows in the same manner as described above until it finally reaches the outlet 7 where it eventually moves through a filter 5.

In the described circuit, the fluid carrying the particles moves in a centrifugal direction on one side of the disk and then in a centripetal direction on the other side. It is first divided into two flows, changes flow direction, meets another flow and collides therewith, is subjected to remixing, while it is continuously in contact with abrasive material where it is subjected to intense milling, and is finally filtered before being discharged.

A similar device may be considered by providing other than circular shapes, for example rectangular, as illustrated schematically in FIG. 21.

A further embodiment of the invention is shown in FIG. 22. According to this embodiment an impeller 3 is mounted on a shaft 2. The impeller is disposed over an abrasive disk 4 also mounted on shaft 2. The impeller comprises a hub 20 fixed to the shaft and at least two blades 23 extending downwardly and radially outwardly from the hub. The blades carry at their lower ends a ring member 22. The blades are inclined with respect to a plane normal to the shaft and project the fluid carrying the particles against the abrasive disk 4, having the aforementioned hard, sharp crystalline cutting points 24 thereon, to create a continuous circulation of the fluid and particles in the enclosure 1.

What is claimed is:

1. A micro-mill mixer comprising in combination:

an enclosure for treating material, the material including particles carried in a fluid, the material to be accelerated in said enclosure, an inlet means in said enclosure for introducing material to be treated into said enclosure, an outlet means for discharging from said enclosure material for which treatment has been completed, at least one abrasive member having at least one face provided with an abrasive coating forming hard, sharp crystalline cutting points, at least one accelerator means for providing both centrigufal and centripetal motion to said material, said accelerator means having internal conduits ejecting the particles and fluid toward the abrasive member and means for effecting flow of material into said accelerator means, so that ejected material continuously re-enters the accelerator means to effect repetitive circulation, said accelerator means and said abrasive member being positioned relative to one another so that the particles and the fluid are projected onto said abrasive member and against said abrasive coating to produce intense splitting, slicing and particle shearing as well as fluid division jointly with coating of said particles by said fluid to form an intimate mix, and said accelerator means and abrasive member being furthermore positioned so as to provide a continuous repetitive circulation of said particles and fluid over said abrasive member.

2. Mixer according to claim 1, wherein the abrasive member is an abrasive disk member having an abrasive coating thereon, said abrasive disc member being disposed adjacent the accelerator means and wherein the conduits of the aforesaid accelerator means eject the material substantially axially against the abrasive coating of the aforesaid abrasive disc member.

3. Mixer according to claim 2, wherein the abrasive disc is rotatable and is driven independently of the accelerator means.

4. Mixer according to claim 2, wherein two accelerator means are mounted on a common drive shaft, the conduits of said accelerator means ejecting the material substantially axially toward one another and the abrasive disc being mounted on the common drive shaft between the accelerator means and having an abrasive coating on each of its sides.

5. Mixer according to claim 2, wherein two independent driven accelerator means are disposed in the enclosure, each accelerator means being associated with a rotatably mounted abrasive disc.

* * * * *